US009042581B2

(12) United States Patent
Zoellin et al.

(10) Patent No.: US 9,042,581 B2
(45) Date of Patent: May 26, 2015

(54) COMPONENT HAVING A MICROMECHANICAL MICROPHONE STRUCTURE, AND METHOD FOR MANUFACTURING SAME

(75) Inventors: Jochen Zoellin, Stuttgart (DE); Axel Grosse, Pfullingen (DE); Bernhard Gehl, Wannweil (DE)

(73) Assignee: ROBERT BOSCH GMBH, Stuttgart (DE)

( * ) Notice: Subject to any disclaimer, the term of this patent is extended or adjusted under 35 U.S.C. 154(b) by 359 days.

(21) Appl. No.: 13/520,444

(22) PCT Filed: Nov. 5, 2010

(86) PCT No.: PCT/EP2010/066854
§ 371 (c)(1),
(2), (4) Date: Sep. 28, 2012

(87) PCT Pub. No.: WO2011/082861
PCT Pub. Date: Jul. 14, 2011

(65) Prior Publication Data

US 2013/0010989 A1 Jan. 10, 2013

(30) Foreign Application Priority Data

Jan. 5, 2010 (DE) ..... 10 2010 000 666

(51) Int. Cl.
*H04R 25/00* (2006.01)
*H04R 19/00* (2006.01)

(52) U.S. Cl.
CPC ..... *H04R 19/005* (2013.01)

(58) Field of Classification Search
CPC .... H04R 19/00; H04R 19/005; H04R 19/016; H04R 19/04; H04R 25/00; H04R 23/006; H04R 21/00; H04R 31/00; H04R 31/108; H04R 31/0224
USPC ..... 381/174, 175; 257/419, 450, E29.324
See application file for complete search history.

(56) References Cited

U.S. PATENT DOCUMENTS 6,535,460 B2 * 3/2003 Loeppert et al. ..... 367/181
7,078,337 B2 7/2006 Campbell et al.

(Continued)

FOREIGN PATENT DOCUMENTS

CN 1651333 A 8/2005
CN 2009-83677 11/2007

(Continued)

OTHER PUBLICATIONS

International Search Report, PCT International Application No. PCT/EP2010/066854, dated Mar. 17, 2011.

(Continued)

*Primary Examiner* — Brian Ensey
(74) *Attorney, Agent, or Firm* — Kenyon & Kenyon LLP

(57) ABSTRACT

Measures for improving the acoustic properties of a microphone component produced in sacrificial layer technology. The micromechanical microphone structure of such a component is implemented in a layered structure, and includes at least one diaphragm, which is deflectable by sound pressure and which is implemented in a diaphragm layer, and a stationary acoustically permeable counterelement for the diaphragm which is implemented in a thick functional layer above the diaphragm layer and which is provided with through openings for introducing sound. The through openings for introducing sound are situated above the middle region of the diaphragm, while perforation openings which are largely acoustically passive are provided in the counterelement, above the edge region of the diaphragm.

8 Claims, 2 Drawing Sheets

(56) References Cited

U.S. PATENT DOCUMENTS

| | | | | |
|---|---|---|---|---|
| 2002/0086455 | A1* | 7/2002 | Franosch et al. | 438/51 |
| 2007/0113664 | A1* | 5/2007 | Wang | 73/718 |

FOREIGN PATENT DOCUMENTS

| | | |
|---|---|---|
| GB | 2436460 | 9/2007 |
| JP | 2008-80444 | 4/2008 |
| KR | 20050032010 | 4/2005 |
| TW | I283887 | 7/2007 |
| WO | WO 0215636 | 2/2002 |

OTHER PUBLICATIONS

Elko et al., "Surface-Micromachined MEMS Microphone," *Preprints of Papers Presented at the AES Convention*, vol. 115, pp. 1-8, Oct. 2003.

* cited by examiner

COMPONENT HAVING A MICROMECHANICAL MICROPHONE STRUCTURE, AND METHOD FOR MANUFACTURING SAME

FIELD OF THE INVENTION

The present invention relates to a component having a micromechanical microphone structure which is implemented in a layered structure. The microphone structure includes at least one diaphragm, which is deflectable by sound pressure and which is implemented in a diaphragm layer, and a stationary acoustically permeable counterelement for the diaphragm which is implemented in a thick functional layer above the diaphragm layer and which is provided with through openings for coupling sound. Moreover, the present invention relates to a method for manufacturing such a microphone component.

BACKGROUND INFORMATION

Microelectromechanical system (MEMS) microphones are becoming increasingly important in various fields of application. This is generally due to the miniaturized design of such components and the possibility for integrating additional functionalities at very low manufacturing costs. Another advantage of MEMS microphones is their high temperature stability.

The signals are generally detected capacitively, the diaphragm of the microphone structure functioning as a movable electrode of a microphone capacitor, and the stationary counterelement representing the support for the corresponding counter electrode. When the diaphragm is deflected by the acoustic pressure, the distance between the diaphragm and the counter electrode changes, which is then detected as a change in capacitance of the microphone capacitor.

Microphone components having a very small chip surface area may be implemented with the aid of surface and volume micromechanical methods and using sacrificial layer etching processes. According to one conventional method, the sound openings in the counterelement are used as etching access points for the sacrificial layer etching process, in which the diaphragm is exposed. In this procedure, the layout of the microphone structure and in particular of the diaphragm is not only determined by the intended microphone properties, but also depends greatly on the options for and properties of the sacrificial layer etching process, for example the etching duration, the isotropy of the etching process, and the boundaries and the spreading of the undercut width. The layout also limits the acoustic properties of a MEMS microphone produced in this way.

Thus, in the conventional microphone components, the lateral distance between the sound openings which are used as etching access and the diaphragm edge is delimited by the undercut width of the sacrificial layer etching process. This distance determines the magnitude of the acoustic short circuit, i.e., the reduction in the sound reception of the microphone diaphragm due to direct pressure compensation between the front side and the back side of the diaphragm. The greater the lateral distance between the sound openings and the diaphragm edge, the lower the effects of the acoustic short circuit on the signal quality, and the better the signal-to-noise ratio (SNR) of the microphone component.

SUMMARY

The present invention provides measures for improving the acoustic properties of a microphone component produced in sacrificial layer technology.

For a component of the type mentioned at the outset, such an improvement is achieved according to the present invention in that the through openings for introducing sound are situated above the middle region of the diaphragm, and that perforation openings which have little acoustic permeability and which therefore are largely acoustically passive are structured in the counterelement, above the edge region of the diaphragm.

In accordance with the present invention, the action of sound should be limited to the greatest extent possible to the middle region of the microphone in order to maximize the length of the acoustic short circuit, and thus to minimize the effects of the action of sound on the sound reception of the microphone diaphragm. Therefore, according to the present invention it is proposed to provide through openings for introducing sound, i.e., sound openings, in the counterelement only above the middle region of the diaphragm. Furthermore, it has been recognized according to the present invention that at constant perforation thickness, the permeability of the perforation openings to sound waves decreases with the diameter of the perforation openings. However, since in sacrificial layer etching the etching attack may occur through even very small perforation openings, according to the present invention such strongly acoustically overdamped, and thus inactive, perforation openings are structured in the counterelement above the edge region of the diaphragm, i.e., between the outermost sound openings and the diaphragm edge. The path of the acoustic short circuit may thus be greatly extended, independently of the undercut width of the sacrificial layer etching process. These very small perforation openings situated above the edge region of the microphone diaphragm also reduce the damping of the microphone diaphragm compared to a completely closed counterelement, since they reduce the squeeze film damping in the gap. For this purpose, the perforation openings may likewise have a punctiform or also a slit-like shape, or may also be linear, curved, or bent.

As previously mentioned, during the sacrificial layer etching the perforation openings located in the counterelement above the edge region of the microphone diaphragm are used as etching access points within the scope of manufacturing the above-described microphone component according to the present invention. Accordingly, a method for manufacturing such a component is provided as well in which a diaphragm is formed by structuring a diaphragm layer of the layered structure, applying at least one sacrificial layer to the diaphragm layer, and producing a thick functional layer on the sacrificial layer, from which a stationary counterelement for the diaphragm is structured. According to the present invention, during the structuring of the thick functional layer, through openings having a size that is suitable for introducing sound are produced above the middle region of the diaphragm, while perforation openings which are largely acoustically passive are produced as through openings above the edge region of the diaphragm. In a subsequent sacrificial layer etching process the sacrificial layer material is then dissolved out between the diaphragm and the counterelement, the etching attack being carried out via the through openings for the sound coupling as well as via the acoustically passive perforation openings in the counterelement.

To optimize the acoustic short circuit while at the same time ensuring production reliability, the perforation openings are arranged in a grid that is matched to the undercut width of the etchant, i.e., so that during an etching attack the sacrificial layer material between the counterelement and the edge region of the diaphragm is completely removed via the perforation openings.

To ensure that the perforation openings above the edge region of the diaphragm are in fact strongly acoustically overdamped or even completely inactive, after the sacrificial layer has been dissolved out the perforation openings may be narrowed or closed off in a targeted manner by depositing a sealing layer on the structured thick functional layer. This procedure opens the possibility for expanding the perforation openings, only for the etching attack within the scope of the manufacturing method, by the layer thickness of the sealing layer in order to facilitate dissolving out the sacrificial layer material.

BRIEF DESCRIPTION OF THE DRAWINGS

As previously discussed, there are various options for advantageously embodying and refining the present invention. For this purpose, reference is made to the description below of one exemplary embodiment of the present invention, with reference to the figures.

DETAILED DESCRIPTION OF EXAMPLE EMBODIMENTS

As stated above, the present invention relates to components having a micromechanical microphone structure which is implemented in a layered structure. The microphone structure includes at least one diaphragm which is provided in a diaphragm layer of the layered structure, and a stationary acoustically permeable counterelement for the diaphragm which is implemented in a thick functional layer above the diaphragm layer. The diaphragm is acted on by the acoustic pressure via sound openings in the counterelement.

Figure 1:
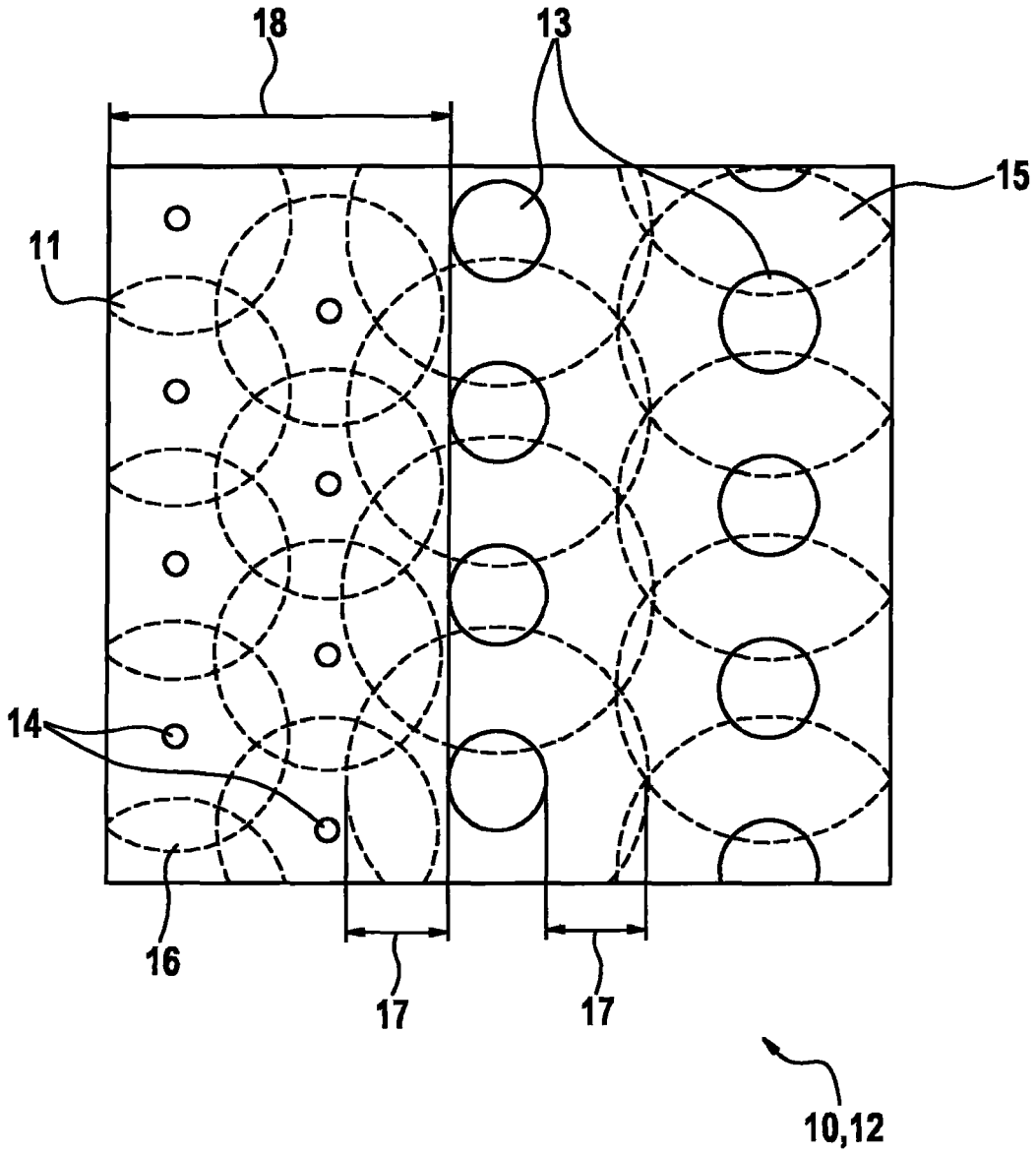
FIG. 1 shows a schematic top view of the counterelement of a microphone component according to the present invention which is provided with through openings.

FIG. 1 illustrates the top view of this type of microphone component 10 and its counterelement 12, in particular, on a region above the lateral diaphragm edge to the middle region of the diaphragm. In the illustrated section, the diaphragm covers counterelement 12. FIG. 1 shows that sound openings 13 are provided in counterelement 12 only above the middle region of the diaphragm, while counterelement 12 is provided only with perforation openings 14 above the edge region of the diaphragm. These perforation openings 14 are much smaller than sound openings 13, and are so small that they are strongly acoustically overdamped and therefore practically acoustically impermeable. Within the scope of the manufacturing method, sound openings 13 as well as perforation openings 14 are used as etching access points for a sacrificial layer etching process in which the sacrificial layer material is dissolved out between the diaphragm layer and counterelement 12 in order to expose the diaphragm. In FIG. 1 the undercut width of this etching process for each sound opening 13 and for each perforation opening 14 is illustrated in the form of a circle 15 and 16, respectively. The degree of overlap of circles 15 illustrates that the grid system of sound openings 13 is more dense than would have been necessary for complete undercutting of counterelement 12, i.e., that the configuration of sound openings 13 primarily takes acoustic considerations into account. In contrast, the grid of perforation openings 14 has been selected in such a way that, although circles 16 completely cover the edge region of the diaphragm, the degree of overlap of circles 16 is relatively small and uniformly distributed. In the present case, the grid of perforation openings 14 has been optimized with regard to complete undercutting of counterelement 12.

For purposes of comparison, the undercut width of outermost sound openings 13, illustrated by arrow 17, and the distance between outermost sound openings 13 and diaphragm edge 11, represented by arrow 18, are particularly emphasized in FIG. 1. The comparison of these two variables illustrates that with the aid of perforation openings 14, a much greater distance between outermost sound openings 13 and diaphragm edge 11 has been achieved than would have been possible using only sound openings 13 as etching access in the sacrificial layer etching process.

Since the influence of the acoustic short circuit on the microphone signal is greater the smaller the distance between the outermost sound openings and the diaphragm edge, perforation openings 14, via which this distance has been increased in the sacrificial layer etching process, contribute to improving the acoustic properties of microphone component 10. In addition, perforation openings 14 reduce the damping of the microphone diaphragm above the edge region of the diaphragm, which likewise has a favorable effect on the acoustic properties of the microphone component.

Thus, for implementing the present invention under discussion, depending on the intended acoustic properties of the microphone component, a row or also an array of acoustically passive etching access points having a small diameter is produced in the counterelement between the diaphragm edge and the sound openings. The number, the size, and the configuration of these perforation openings depend on the computed optimum with regard to the acoustic, mechanical, and electrical properties, such as damping, sensitivity, signal-to-noise ratio, and also on the structuring options in the manufacturing process. A compromise must be found between large perforation openings on the one hand, which is associated with low damping of the microphone diaphragm, and a perforation structure having a high acoustic resistance on the other hand, thus increasing the electrical sensitivity of the microphone structure and reducing the noise of the acoustic short circuit.

Thus, according to the present invention, the perforation openings meet two criteria. First, the perforation openings should be large enough to be able to function as etching access for the sacrificial layer etching process. Second, they should be small enough to be as acoustically impermeable as possible. To meet these seemingly contradictory requirements, after the sacrificial layer etching process the perforation openings may be narrowed or even completely closed off with the aid of a sealing layer. The process sequence used for this purpose is illustrated in FIGS. 2*a* through 2*c*.

Figure 2A:
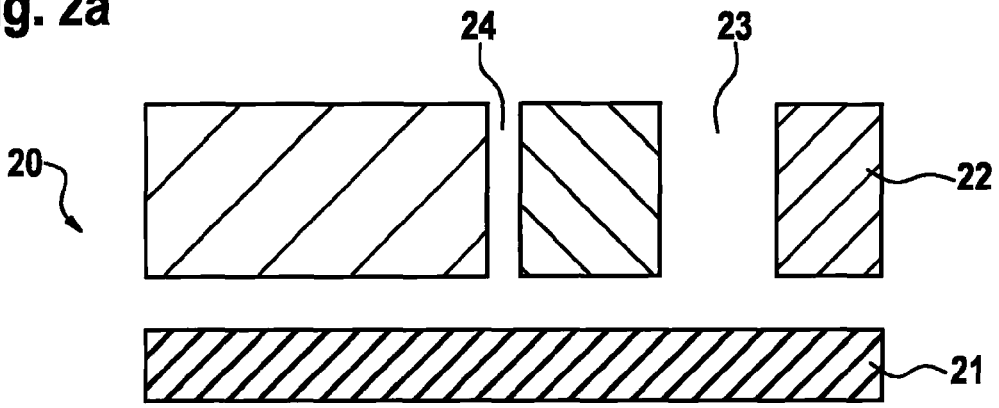
FIGS. 2*a* through 2*c* show schematic sectional illustrations of the layered structure of a microphone component according to the present invention during the sealing of perforation openings.
Figure 2B:
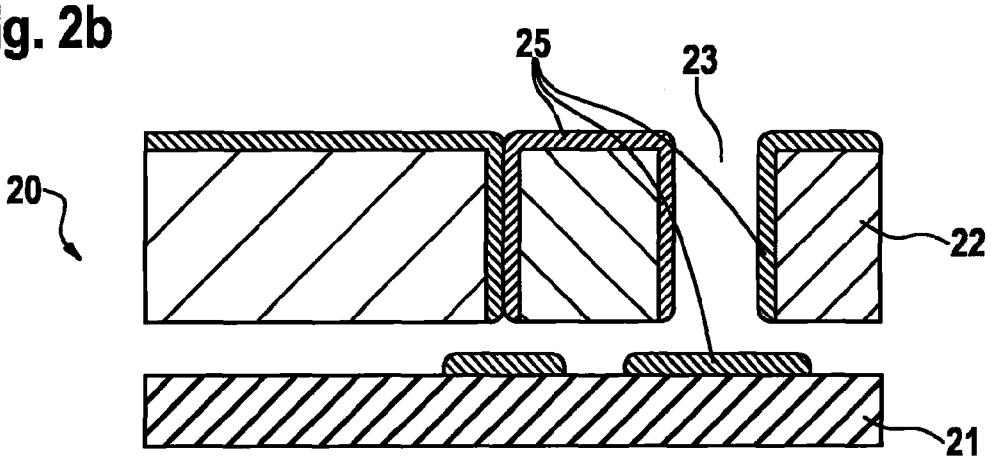
Figure 2C:
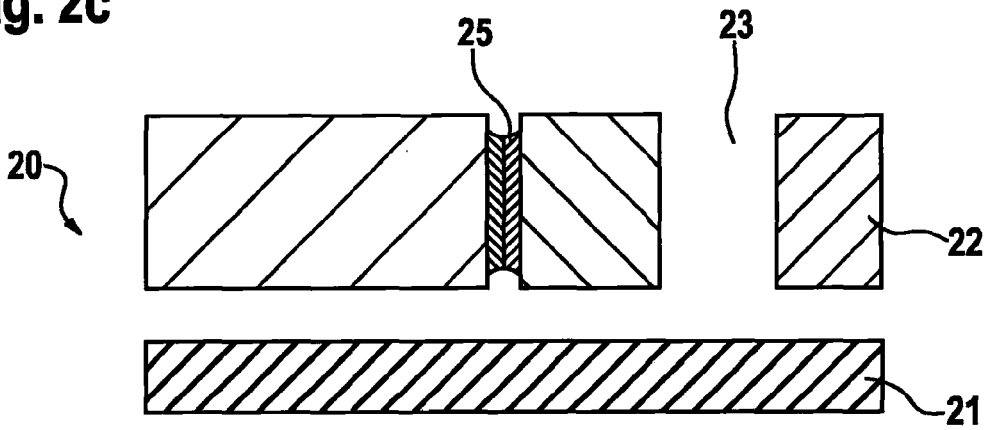

FIG. 2*a* illustrates the upper part of the layered structure of a microphone component 20, having diaphragm 21 and counterelement 22 in the area of the diaphragm edge, after the sacrificial layer material between diaphragm 21 and counterelement 22 has been removed in a sacrificial layer etching process. The etching attack has been carried out via through openings 23 and 24 in the counterelement. Through openings 23 situated above the middle region of diaphragm 21 are provided as sound openings, while through openings 24 in the edge region of diaphragm 21 are implemented in the form of perforation openings having a very small cross section.

Subsequent to the sacrificial layer etching process, a sealing layer 25, for example a PECVD oxide, has been deposited on the component surface. The material of this sealing layer 25 has also been applied to diaphragm 21 and the opening walls via through openings 23 and 24. Sound openings 23 have been merely narrowed by sealing layer 25, while smaller perforation openings 24 have been completely closed off here, as illustrated in FIG. 2*b*.

Lastly, in a further brief gas phase etching step, sealing layer 25 has been largely removed from counterelement 22 and diaphragm 21. FIG. 2*c* shows that the material of sealing layer 25 has also been removed from the walls of sound openings 23, while completely sealed perforation openings 24 having a small diameter have been closed off or at least greatly narrowed. This is due to the greatly reduced attack surface for the etching process on the front and back sides of counterelement 22.

What is claimed is:

1. A component having a micromechanical microphone structure which is implemented in a layered structure, comprising:

a diaphragm which is deflectable by sound pressure and which is implemented in a diaphragm layer; and a stationary acoustically permeable counterelement for the diaphragm which is implemented in a thick functional layer above the diaphragm layer and which is provided with through openings for coupling sound, wherein the through openings for the sound coupling are situated above a middle region of the diaphragm, and perforation openings which are largely acoustically passive and acoustically impermeable, and which are smaller than the through openings, are structured in the counterelement, above an edge region of the diaphragm.

2. The component as recited in claim 1, wherein the counterelement is completely undercut, the through openings and the perforation openings being situated above the undercut.

3. The component as recited in claim 1, wherein the perforation openings are narrowed by material of at least one sealing layer which is applied to the thick functional layer.

4. The component as recited in claim 1, wherein the perforation openings are closed off by material of at least one sealing layer which is applied to the thick functional layer.

5. A method for manufacturing a component having a micromechanical microphone structure which is implemented in a layered structure, comprising:

forming a diaphragm by structuring a diaphragm layer; applying at least one sacrificial layer to the diaphragm layer;

producing a thick functional layer on the sacrificial layer and structuring the thick functional layer, a stationary counterelement for the diaphragm being formed and provided with through openings; and dissolving out the sacrificial layer material between the diaphragm and the counterelement in a sacrificial layer etching process, an etching attack being carried out via the through openings in the counterelement;

wherein during the structuring of the thick functional layer, through openings having a size that is suitable for introducing sound are produced above a middle region of the diaphragm, and perforation openings which are largely acoustically passive are produced as through openings above an edge region of the diaphragm.

6. The method as recited in claim 5, wherein the counterelement is completely undercut, the undercutting being carried out using a sacrificial layer etching process, and the through openings and the perforation openings being used as etching access.

7. The method as recited in claim 5, wherein the perforation openings are arranged in a grid that is matched to the undercut width of the etchant.

8. The method as recited in claim 5, wherein after the sacrificial layer material has been dissolved out, the perforation openings are one of narrowed or closed off in a targeted manner by depositing a sealing layer on the structured thick functional layer.

* * * * *